US005808532A

United States Patent [19]

DiVincenzo et al.

[11] Patent Number: 5,808,532

[45] Date of Patent: Sep. 15, 1998

[54] MOTORIZED MODULE FOR FIELD ASSEMBLY TO CIRCUIT BREAKERS

[75] Inventors: Gregory T. DiVincenzo, Putnam; Andrew W. Macy, Niantic; Joseph F. Noonan, Bolton, all of Conn.

[73] Assignee: Circuit Protection & Controls, Inc., Niantic, Conn.

[21] Appl. No.: 616,061

[22] Filed: Mar. 26, 1996

Related U.S. Application Data

[63] Continuation-in-part of Ser. No. 590,949, Jan. 24, 1996, abandoned.

[51] Int. Cl.[6] ..... H01H 3/00

[52] U.S. Cl. ..... 335/68; 335/202; 200/400

[58] Field of Search ..... 335/68, 65, 69, 335/70, 71, 72, 131, 202, 73, 74, 75; 200/400, 401, 330, 331, 331.1, 332, 337, 303

[56] References Cited

U.S. PATENT DOCUMENTS

| | | | |
|---|---|---|---|
| 3,171,920 | 3/1965 | Klein et al. . | |
| 3,296,565 | 1/1967 | Kiesel et al. . | |
| 3,629,744 | 12/1971 | Maier et al. . | |
| 5,160,908 | 11/1992 | Mullins et al. | 335/68 |
| 5,323,131 | 6/1994 | Castonguay | 335/68 |
| 5,504,290 | 4/1996 | Baginski et al. | 200/401 |

*Primary Examiner*—Lincoln Donovan

*Attorney, Agent, or Firm*—Bachman & LaPointe, P.C.

[57] ABSTRACT

A motor module for operating a circuit breaker having a front face and a switch exposed at the front face, wherein the motor module includes: a housing; a motor disposed in the housing and having a switch engaging member for operatively associating the motor with the switch; and an engaging member associated with the housing for engaging the housing with the front face of the circuit breaker, with the switch engaging member engaged with the switch, whereby the housing is mounted over the front face of the circuit breaker with the motor operatively associated with the switch.

10 Claims, 3 Drawing Sheets

MOTORIZED MODULE FOR FIELD ASSEMBLY TO CIRCUIT BREAKERS

CROSS-REFERENCE TO RELATED APPLICATIONS

This application is a Continuation-In-Part application of application Ser. No. 08/590,949, now abandoned, for a MOTORIZED MODULE FOR FIELD ASSEMBLY TO CIRCUIT BREAKERS, By Gregory T. DiVincenzo et al., filed Jan. 24, 1996.

BACKGROUND OF THE INVENTION

The invention relates to a motor module for automatically and remotely operating circuit breaker switches and the like.

It is frequently desirable to arrange circuit breaker installations so that the circuit breaker can automatically, and preferably remotely, be opened, closed and reset. Typical installations require hard wiring, on/off push buttons and side mounted devices. Such devices have several drawbacks, including the inefficient use of space, additional required hardware, and potentially unreliable wiring. The need remains for a simple, efficient and reliable device for automatically and remotely operating circuit breaker switches.

It is therefore the primary object of the present invention to provide a motor module for operating circuit breaker switches which mounts to the front face of the circuit breaker and thereby conserves space.

It is a further object of the present invention to provide a motor module device which is readily installed on existing circuit breaker hardware.

It is a still further object of the present invention to provide a motor module device wherein position of the circuit breaker switch is indicated in a readily visible manner from the front face of the motor module.

It is another object of the present invention to provide a motor module device wherein operation of the circuit breaker switch is not impeded by the motor module device.

Other objects and advantages of the present invention will appear hereinbelow.

SUMMARY OF THE INVENTION

In accordance with the present invention, the foregoing objects and advantages are readily attained.

According to the invention, a motor module is provided for operating a circuit breaker having a front face and switch means exposed at said front face, wherein said motor module comprises a housing; a motor disposed in said housing and having switch engaging means for operatively associating said motor with said switch means; and engaging means associated with said housing for engaging said housing with said front face of said circuit breaker, with said switch engaging means engaged with said switch means, whereby said housing is mounted over said front face of said circuit breaker with said motor operatively associated with said switch means.

The motor module according to the invention is particularly useful with compact miniature magnetic dashpot devices which may be single, double or triple pole devices.

In accordance with a preferred embodiment of the invention, the motor module is further provided with switch engaging means comprising an actuator positioned within the housing and movable from a first position along a path to a second position for positioning the switch means to an on position, and movable from the second position along the path to the first position for positioning the switch means to an off position, the actuator having a first mode of operation for releasably pushing the switch means toward the on position, and a second mode of operation for releasably pushing the switch means toward the off position whereby, after the switch means is moved past a pre-selected point along the path, the switch means is free to snap forward along the path to the on or off position.

BRIEF DESCRIPTION OF THE DRAWINGS

A detailed description of preferred embodiments of the present invention follows, with reference to the attached drawings, wherein.

DETAILED DESCRIPTION OF THE PREFERRED EMBODIMENT

The invention relates to a motor module for automatically and remotely operating circuit breaker switches and the like, especially miniature magnetic dashpot type circuit breaker switches.

Figure 1:
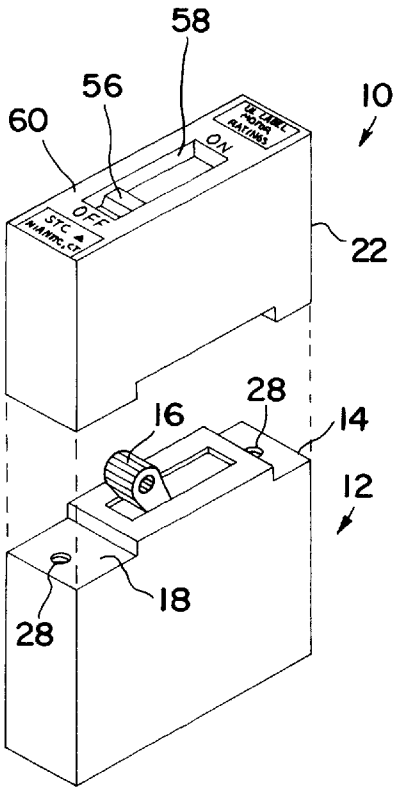
FIG. 1 is a schematic partially exploded view of a motor module according to the invention.

Referring to the drawings, FIG. 1 illustrates a motor module 10 according to the invention, positioned above a conventional circuit breaker switch housing 12. As shown in FIG. 1, the typical switch housing 12 for use in accordance with the present invention includes a base portion 14 containing the various circuitry for operation in connection with circuit breaker switch housing 12, and a switch member 16, positionable between on, off and tripped positions, for opening, closing and resetting the circuit in which circuit breaker switch housing 12 is positioned.

According to the invention, module 10 is positioned over the front face 18 of base member 14 and interacts with switch member 16 so as to provide automatic and remote control of same. The internal elements and operation of module 10 according to the invention will be thoroughly discussed below.

Figure 2:
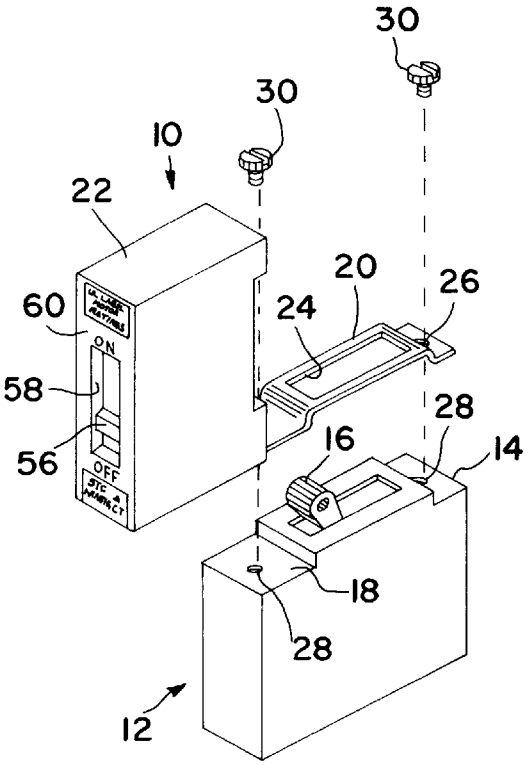
FIG. 2 is a perspective partially exploded view of a motor module according to the invention arranged for installation.

Referring now to FIG. 2, module 10 preferably includes a mounting plate 20 which is hingedly positioned with respect to a housing 22 of module 10, and which is adapted for attachment to front face 18 of base member 14. As shown in FIG. 2, mounting plate 20 preferably includes a slot portion 24 arranged to register with the required motion of switch member 16, and several apertures 26 arranged to mate with apertures 28 on front face 18 of base member 14. Module 10 is installed to front face 18 of base member 14 by securing fasteners 30 through apertures 26 and into apertures 28. This may typically be accomplished using threaded inserts which are typically permanently housed in circuit breaker switch housing 12.

Figure 3:
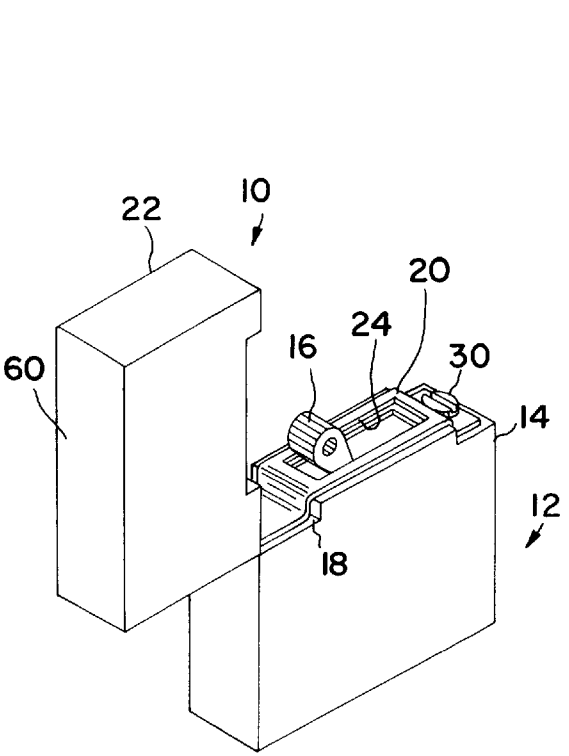
FIG. 3 is another perspective view of a motor module according to the present invention, installed on a circuit breaker.

Referring to FIG. 3, it is readily apparent that once fasteners 30 are in place securing mounting plate 20 to front face 18, housing 22 of module 10 can then be pivoted with respect to mounting plate 20 into position so as to operate switch member 16 as desired and as will be discussed in further detail below. The presently described mounting of module 10 with respect to base member 14 is advantageous in that lateral space with respect to base member 14 is conserved.

Figure 4:
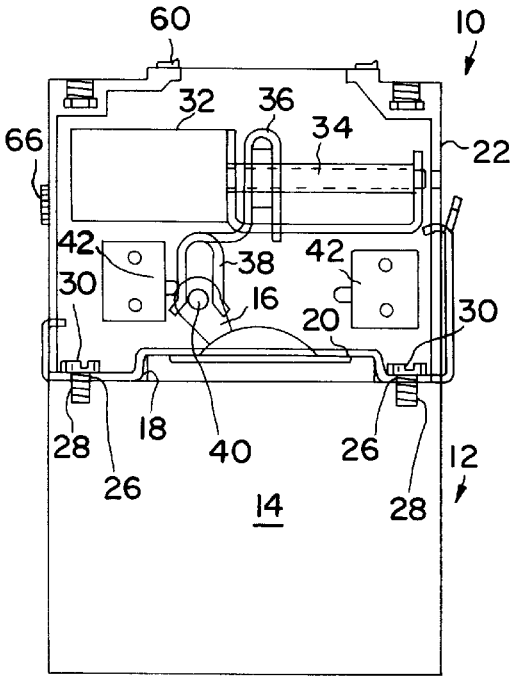
FIGS. 4 and 5 are side schematic views of a motor module according to the invention.
Figure 5:
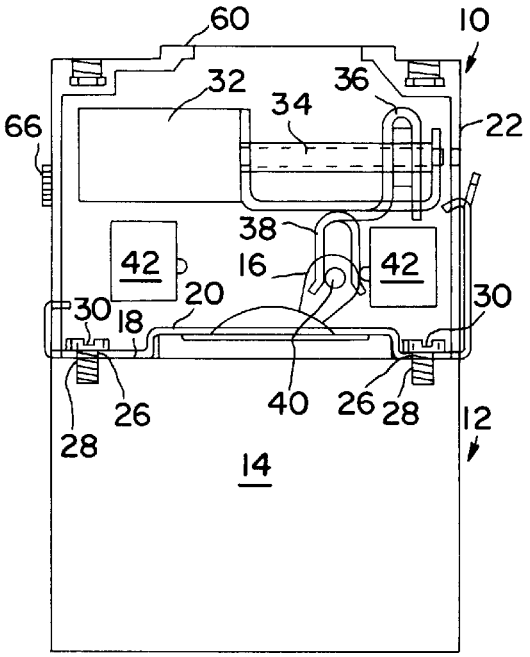

Referring now to FIGS. 4 and 5, the internal elements of module 10 which act in conjunction with switch member 16 to provide the desired automatic and remote operation of circuit breaker 12 will be described. As shown in FIG. 4, a motor 32 is preferably positioned within housing 22 and wired for remote control in any conventional manner. An example of a suitable motor is a 5.9 volt DC motor, preferably including a voltage regulator, which is controllable so as to rotate a worm gear 34, preferably in both directions, so that module 10 may be operated to open and close the switch of a circuit breaker on which module 10 is installed. Of course, numerous other types and sizes of motors may be used in accordance with the invention.

As shown in FIGS. 4 and 5, a support member 36 is positioned on worm gear 34 so that rotation of worm gear 34 by motor 32 drives support member 36 back and forth between the positions illustrated in FIGS. 4 and 5. In further accordance with invention, support member 36 supports a bracket member 38 which is shaped to receive switch member 16 as illustrated. When module 10 is installed, bracket member 38 is positioned over switch member 16, for example, over a pin portion 40 of switch member 16, so that positioning of support member 36 along worm gear 34 as illustrated in FIGS. 4 and 5 results in positioning of switch member 16 between on and off positions, also as illustrated in FIGS. 4 and 5.

In accordance with a preferred embodiment of the invention, limit switches 42 are preferably positioned within housing 22 at extreme ends of the intended course of travel of bracket member 38 engaged with switch member 16. In this manner, operation of motor 32 can readily be stopped once bracket member 38 with engaged switch 16 is positioned to a desired location.

Figure 6:
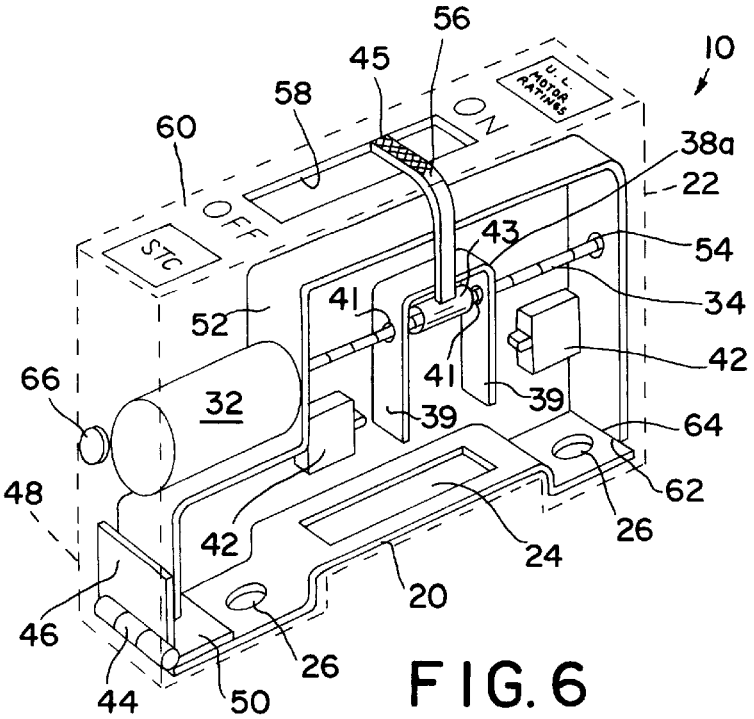
FIG. 6 is a perspective view of an alternate embodiment of the invention.

Referring now to FIG. 6, a further alternative embodiment of the invention will be described.

FIG. 6 further illustrates the hinged connection of mounting plate 20 within housing 22. As shown, a hinge member 44 may suitably be mounted within housing 22, for example with a first hinge part 46 attached to a side wall 48 of housing 22. Mounting plate 20 may suitably be affixed to second hinge part 50 of hinge member 44 so as to advantageously allow pivot of housing 22 with respect to mounting plate 20. As set forth above, this advantageously allows housing 22 to be pivoted out of the way during installation of module 10. Of course, it should be appreciated that numerous other configurations may be utilized to provide pivotable association between mounting plate 20 and housing 22 according to the invention.

Also as illustrated in FIG. 6, motor 32 may suitably be mounted to a motor bracket 52 mounted within housing 22 so that motor 32 is suitably supported within module 10. As shown, motor bracket 52 may suitably include apertures or recesses 54 for receiving worm gear 34 so as to firmly support same during rotation and operation of module 10 in accordance with the invention. Limit switches 42 in accordance with this embodiment may suitably be positioned on inwardly facing and opposing sides of motor bracket 52 as shown.

Still referring to FIG. 6, it should be noted that an alternate embodiment of support member 36 and bracket member 38 (FIGS. 4 and 5) is illustrated wherein a bracket member 38*a* is mounted directly onto worm gear 34. Bracket member 38*a* according to this embodiment is a substantially U-shaped member positioned with the opening of the U facing toward switch 16 to be engaged between arms 39 of bracket member 38*a* as shown. Openings 41 located in arms 39 allow passage of worm gear 34, and a collar member 43 positioned on worm gear 34 drives collar member 43, and thereby bracket member 38*a,* along worm gear 34 as desired.

In further accordance with the invention, an indicator member 56 may suitably be mounted to collar member 43 as shown in FIG. 6, and housing 22 may suitably further include a slot portion 58 for receiving an end 45 of indicator member 56 as shown so that the position of switch member 16, bracket member 38 and indicator member 56 can readily be ascertained from a front face 60 of module 10. Of course, indicator member 56 could also suitably be mounted to any other element of module 10 which moves with switch 16 such as, for example, bracket member 38*a,* or support member 36 or bracket member 38 of the embodiment of FIGS. 4 and 5. Module 10 may further include indicia on front face 60 such as ON/OFF indicators, U.L. labels and other information such as a company name and the like, if desired.

Still referring to FIG. 6, snapping or other structure may preferably be provided at the non-hinged end 62 of mounting plate 20 and a portion of housing 22, so as to retain housing 22 in a closed position, as shown in FIG. 6, with respect to mounting plate 20, and to thereby ensure stability and proper engagement and operation of bracket member 38 with switch member 16. For example, an end 64 of motor bracket 52 mounted within housing 22 could be adapted to snap into place in a closed position over end 62 of mounting plate 20.

Still referring to FIG. 6, wires for powering and controlling motor 32 may suitably be positioned in a strain relief member 66 and connected to a control signal receiver member (not shown) or hard wired to a control member as desired. Strain relief member 66 serves to protect the internal components of module 10 from damage due to forces applied to wiring and the like.

When servicing equipment, a technician can readily unsnap motor module 10 from circuit breaker housing 12, and pivot housing 22 away from circuit breaker housing 12 to allow access to and manual operation of the circuit breaker. When servicing is completed, housing 22 can then be pivoted and snapped back into position for resumed operation in accordance with the invention.

Figure 7:
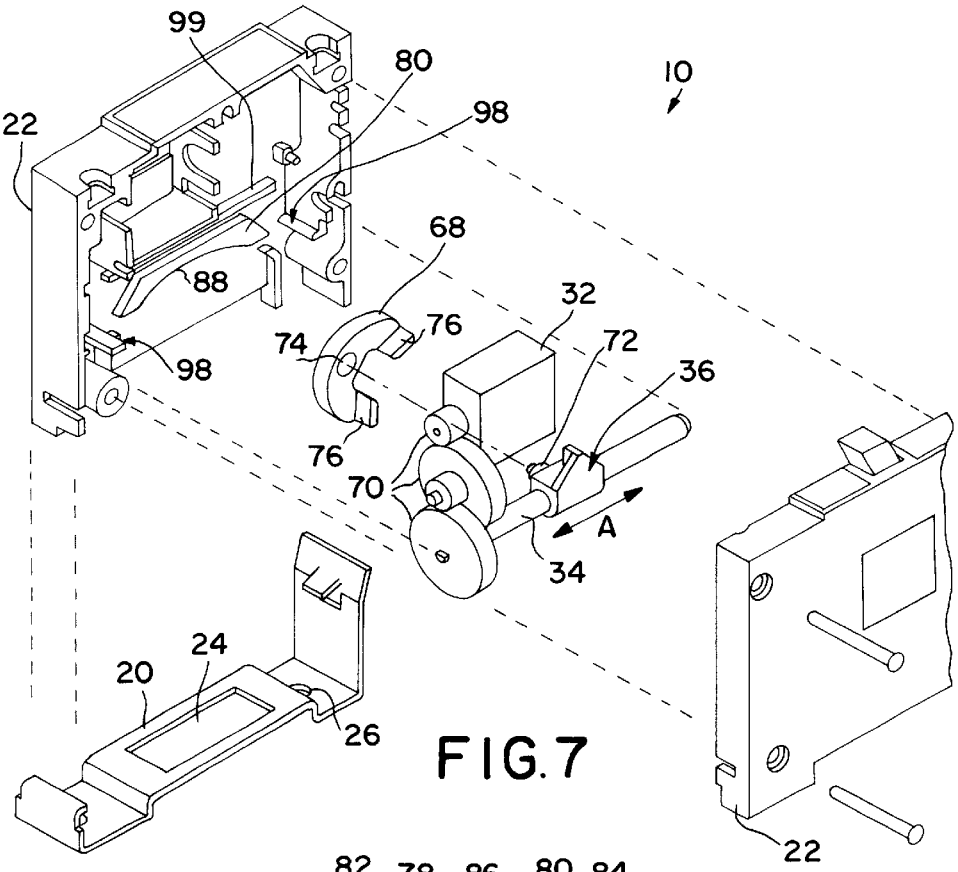
FIG. 7 is a perspective view of an alternate embodiment of the invention.

Referring now to FIG. 7, a further embodiment of the present invention will be described wherein switch member 16 is releasably engaged by an alternative embodiment of a bracket member, illustrated in FIG. 7 as actuator 68, which advantageously allows switch member 16 to snap forward to a final on or off position without being impeded by actuator 68. In accordance with this embodiment, switch 16 is free to snap forward in the direction it is being moved, after being positioned past a central portion beyond which internal structure of switch 16 completes the positioning as desired. FIG. 7 shows module 10 in an exploded view including switch housing 22 which in this embodiment is a two piece member shown exploded for greater detail.

As shown in FIG. 7, motor 32 may suitably be operatively associated with worm gear 34, for example through several gears 70 as shown in the drawing. Support member 36 is preferably threadably and non-rotatably engaged with worm gear 34 so that rotation of worm gear 34 serves to position support member 36 along worm gear 34 as illustrated by arrow A, depending upon the direction of rotation of worm gear 34. Support member 36 in accordance with the invention may suitably have an arm member 72 extending therefrom for rotatably receiving actuator 68. To this end, actuator 68 preferably has a hole or recess 74 for receiving arm 72.

Figure 8:
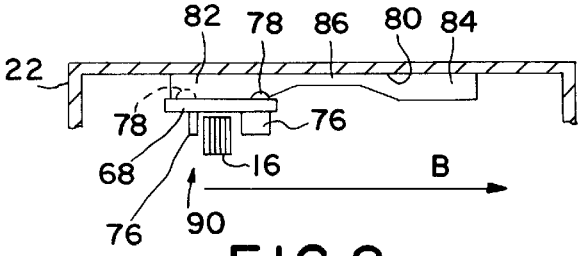
FIG. 8 is a top sectional view of a portion of the embodiment of FIG. 7.

In accordance with the invention, actuator 68 is preferably a substantially flat planar member having two tab members 76 extending from one side, and having engaging structure such as knobs 78 (see FIG. 8) positioned on the other side. In further accordance with this embodiment of the invention, and returning to FIG. 7, housing 22 is preferably provided with a rib member 80 preferably positioned substantially parallel to a path of travel of actuator 68 along worm gear 34, for engaging with knobs 78 as will be discussed below. Referring to FIGS. 7 and 8, rib 80 is preferably a projecting ridge-like structure formed on or attached to housing 22 and extending inwardly toward actuator 68 so as to define a thickness.

Referring particularly to FIG. 8, rib 80 preferably has end portions 82, 84 having a thickness or otherwise extending inwardly so as to engage one knob 78 positioned thereunder and thereby resist rotation of actuator 68 around the axis of arm 72. Rib 80 thereby serves to firmly hold actuator 68 in position during a switching operation as desired and as will be further described below.

Rib 80 also preferably has a central section 86 having a substantially narrowed thickness or being otherwise positioned and arranged with respect to actuator 68 so that knobs 78 can freely pass rib 80 when aligned with central section 86. Central section 86 advantageously serves to release actuator 68 from engagement with rib 80 after switch member 16 has been sufficiently displaced to a point where it snaps forward to a rest position, either "on" or "off".

Referring back to FIG. 7, rib 80 preferably has a lower or support surface 88 against which knobs 78 engage, and support surface 88 may suitably have a substantially arcuate shape as shown in the drawing so as to facilitate the selective engaging and disengaging of knobs 78 with rib 80 as desired.

Figure 9:
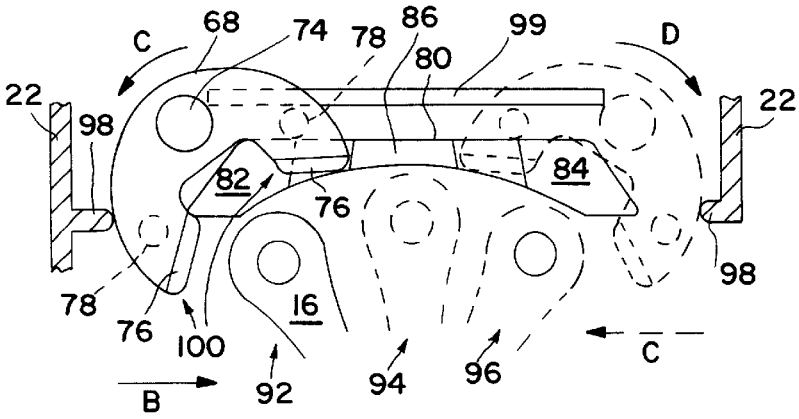
FIG. 9 is a side sectional view of a portion of the embodiment of FIG. 7.

Referring to FIG. 8, actuator 68 is shown in a starting position 90 with one tab 76 engaging switch member 16, and one knob 78 positioned below and contacting rib 80 at end 82. When module 10 in accordance with the invention is to be operated, motor 32 is actuated and support member 36 carrying actuator 68 is moved or positioned along worm gear 34 and the path defined thereby in the direction of arrow B as shown in FIG. 8. Tab 76 which is releasably engaged with switch member 16 serves to push against switch member 16 so as to operate the underlying circuit breaker as desired. Referring also to FIG. 9, and advantageously, the engaging of knob 78 with support surface 88 of rib 80 serves to hold actuator 68 in position against torque generated by resistance of switch member 16, and thereby serves to hold actuator 68 in a first position or mode of operation shown in solid lines in FIG. 9 so as to releasably push switch member 16 from an "on" position 92 corresponding to the starting position 90 of FIG. 8, to an intermediate or midpoint position 94 and subsequently to an "off" position 96 as shown in hidden lines in FIG. 9. As will be further discussed below, module 10 according to the invention advantageously serves to provide for positioning of switch member 16 back to "on" position in like manner.

As is well known in the art, circuit breaker switches such as those which are contemplated for use in connection with the present invention typically resist positioning of switch member 16 until switch member 16 reaches a certain position along the path of movement thereof, at which point interior biasing structure of the circuit breaker acts on switch member 16 and snaps same forward to a resting position. It is a notable advantage of the present invention to allow switch member 16 to freely snap forward, thereby providing a more rapid connection or disconnection along the circuit operated by module 10 as desired. In accordance with this embodiment of the invention, actuator 68 serves to releasably push against switch member 16 and, once switch member 16 has reached the pre-selected midpoint 94 of its path of motion, allows switch member 16 to snap forward the rest of the way to the final on or off position depending upon the direction of operation of module 10.

In further accordance with this embodiment of the invention, actuator 68 is preferably rotatably mounted on arm 72 to allow rotation or other positioning of actuator 68 to positions or modes of operation such that switch member 16 can be operated in either direction as indicated by arrows A in FIG. 7. According to the invention, housing 22 is preferably further provided with cam members 98 and preferably guide 99 formed on or otherwise attached to or associated with housing 22 and arranged to cam actuator 68 into a proper position for use in positioning or returning switch member 16 back in an opposite direction, for example from position 96 to position 92 as illustrated in FIG. 9.

As shown in FIG. 9, two cams 98 may suitably be positioned, one at each end of a path of movement of actuator 68 in housing 22, so that actuator 68 contacts a cam 98 when approaching the end of movement in a particular direction. When cam 98 contacts actuator 68, actuator 68 is rotated as shown by arrows C, D in FIG. 9 to one or the other of the positions illustrated. Guide 99 is preferably positioned according to the invention to contact actuator 68, preferably knob 78 which has just been released through central section 86 of rib 80, so as to stop rotation of actuator 68 due to cam 98 and thereby leave actuator 68 aligned and ready for the next operation of module 10 in a direction opposite to that just completed. Of course, a wide variety of shapes and locations of cams 98 and/or guide 99 would be suitable according to the invention to rotate and reset actuator 68 as desired.

Referring to FIGS. 7–9 collectively, the operation of this embodiment of the present invention will be further described. Module 10 is positioned over a switch housing 12 as discussed in accordance with the present invention. In this configuration, switch 16 may suitably be positioned in an "on" position 92, and actuator 68 positioned at starting position 90 with tab 76 positioned substantially adjacent to switch member 16 and one knob 78 aligned so as to engage with rib 80 and the other knob 78 aligned to travel along guide 99.

When switch member 16 is to be switched to the "off" position 96, motor 32 is actuated so as to rotate worm gear 34 through gears 70 and thereby drive support member 36 along the path defined by worm gear 34. This results in movement of actuator 68 in the direction of arrow B in FIG. 9, resulting in the contact of tab member 76 with switch member 16 as desired in accordance with the invention.

Further operation of motor 32 causes actuator 68 to releasably push against switch member 16, with knob 78 engaged on rib 80 and thereby holding actuator 68 in the desired position, so as to push switch member 16 to a pre-selected central or intermediate position 94 from which point switch member 16 is free to snap forward the rest of the way to "off" position 96. Further operation of motor 32 brings actuator 68 further along the path defined by worm gear 34 until knob 78 is aligned with central portion 86 of rib 80. At this point, knob 78 is no longer firmly engaged with rib 80 due to the decrease in thickness of same, and further operation of motor 32 will result in actuator 68 contacting cam 98 so as to rotate actuator 68 in the direction of arrow D in FIG. 9 to the position illustrated in dashed lines with the just-released knob 78 contacting guide 99 and the other knob 78 aligned to engage with rib 80. Once rotated to this position or mode of operation, actuator 68 is now in proper position for reverse operation of motor 32 which results in reverse movement of actuator 68 back along the path defined by worm gear 34 in the direction of arrow C so as to position switch member 16 from the "off" position 96 to the "on" position 92 in substantially the reverse manner as that described above.

In further accordance with this embodiment of the invention, actuator 68 preferably has a substantially rounded U-shape with tabs 76 positioned at the tips of extending arm members 100. Arms 100 further preferably have rounded edges so as to further ensure the free release of switch member 16 from actuator 68 when switch member 16 reaches the pre-selected central or intermediate position 94 at which it is desirable to allow switch member 16 to snap forward to the end of its path of movement.

In accordance with the invention, it should be readily apparent that a motor module has been provided in accordance with the invention for effectively providing automatic remote control of circuit breaker switches in a space efficient and advantageous manner. Motor module 10 in accordance with the invention is especially suitable for use with circuit breakers of the magnetic dashpot type, for example Philips Airpax, IEL; Hienemann AMI, Carling Switch Series C, and Potter and Brumfield W93. Numerous other circuit breaker types may also suitably be automated with the motor module of the present invention.

The motor module of the present invention is advantageously designed for field installation on existing circuits as well as new applications which are greatly facilitated by hinge member 44 in combination with mounting plate 20 in accordance with the invention.

It should be noted that module 10 according to the invention is useful for operating numerous pole devices as well. When more than three poles are to be operated remotely, additional modules 10 can readily be used. For example, some applications require up to 9 or 12 poles on a circuit breaker. No specialized additional equipment would be required to install modules 10 for such a circuit breaker.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A motor module for operating a circuit breaker having a front face and switch means exposed at said front face, said motor module comprising:

a housing;

a motor disposed in said housing and having switch engaging means for operatively associating said motor with said switch means;

engaging means associated with said housing for engaging said housing with said front face of said circuit breaker, with said switch engaging means engaged with said switch means, whereby said housing is mounted over said front face of said circuit breaker with said motor operatively associated with said switch means; and circuit breaker position indicator means arranged within said housing visible from said front face of said housing and associated with said switch engaging means whereby positioning of the switch of the circuit breaker results in corresponding positioning of said circuit breaker position indicator means.

2. A motor module according to claim 1, wherein said engaging means comprises a hinge member having a first hinge part and a second hinge part pivotably attached to said first hinge part, and wherein said first hinge part is attached to said housing and said second hinge part is adapted for engaging with said front face of said circuit breaker.

3. A motor module according to claim 2, wherein said second hinge part has a substantially centrally located slot for receiving the switch of the circuit breaker.

4. A motor module according to claim 3, wherein said second hinge part further includes a series of apertures arranged to overlap apertures positioned in said front face of said circuit breaker, and fastener members for passing through said apertures of said second hinge part and engaging with said apertures of said circuit breaker whereby said second hinge part is engaged with said circuit breaker.

5. A motor module according to claim 2, wherein said first hinge part and said second hinge part are pivotable relative to each other between a first position wherein said first hinge part with said housing are pivoted away from said second hinge part and said second hinge part is exposed for attachment to the front face of the circuit breaker, and a second position wherein said first hinge part is pivoted substantially adjacent to said second hinge part.

6. A motor module according to claim 5, further comprising means for retaining said first hinge part and said second hinge part in said second position whereby said housing is held in place for operation with said engaging means engaged with the switch.

7. A motor module according to claim 1, wherein said switch engaging means comprises a bracket member for receiving the switch, said bracket member being associated with said motor whereby operation of said motor positions said bracket member, thereby positioning the switch of the circuit breaker.

8. A motor module according to claim 7, wherein said motor has a shaft arranged to be rotated by said motor, and wherein said bracket member is threadably arranged on said shaft whereby rotation of said shaft results in longitudinal displacement of said bracket member along said shaft.

9. A motor module according to claim 7, wherein said front face of said housing has a slot portion, and further comprising an extension member associated with said bracket member and extending at least toward said slot portion whereby position of said bracket member is indicated from said front face of said housing.

10. A motor module according to claim 9, wherein said front face of said housing has indicia means arranged at each end of said slot portion whereby position of said extension member is readily indicated.

* * * * *